US008403767B2

(12) United States Patent
Zhang

(10) Patent No.: US 8,403,767 B2
(45) Date of Patent: Mar. 26, 2013

(54) INFANT SWING APPARATUS

(75) Inventor: Da Liang Zhang, Kowloon (TW)

(73) Assignee: BP Children's Products HK Co., Limited, Hong Kong (HK)

( * ) Notice: Subject to any disclaimer, the term of this patent is extended or adjusted under 35 U.S.C. 154(b) by 309 days.

(21) Appl. No.: 12/844,448

(22) Filed: Jul. 27, 2010

(65) Prior Publication Data

US 2011/0028228 A1 Feb. 3, 2011

(30) Foreign Application Priority Data

Jul. 29, 2009 (CN) ..... 2009 1 0164914

(51) Int. Cl.
*A63G 9/16* (2006.01)
*A63G 9/00* (2006.01)

(52) U.S. Cl. ..... 472/119; 297/273

(58) Field of Classification Search ..... 472/118–125; 297/184.1, 184.11, 184.13, 273, 274, 277, 297/278, 301.1, 301.5; 5/101, 102
See application file for complete search history.

(56) References Cited

U.S. PATENT DOCUMENTS 3,765,674 A * 10/1973 Siler ..... 297/273
D359,857 S * 7/1995 Bartlett ..... D6/347
6,173,725 B1 * 1/2001 Garth ..... 135/87
6,887,161 B2 * 5/2005 Mahlstedt et al. ..... 472/119
6,974,388 B1 * 12/2005 Williams, Jr. ..... 472/118
7,475,942 B2 * 1/2009 Boyle et al. ..... 297/278
7,565,910 B2 * 7/2009 Alexakis ..... 135/117
7,878,915 B2 * 2/2011 Myers et al. ..... 472/119

FOREIGN PATENT DOCUMENTS

CN 2891852 4/2007
CN 201171525 12/2008

* cited by examiner

*Primary Examiner* — Kien Nguyen
(74) *Attorney, Agent, or Firm* — Baker & McKenzie LLP

(57) ABSTRACT

An infant swing apparatus comprises a support structure and at least one swing arm pivotally coupled with the support structure, a seat, including a backrest support tube, and a recline assembly connecting the seat with the swing arm. The recline assembly comprises a first coupling shell fixedly coupled with the backrest support tube, a second coupling shell fixedly coupled with the swing arm and pivotally assembled with the first coupling shell, a latch member assembled between the first and second coupling shell, wherein the latch member is movable along an axle of rotation between the first and second coupling shell, and an actuator mechanism operable to cause the latch member to move from a first position locking the first and second coupling shell with each other, to a second position unlocking the first coupling shell from the second coupling shell.

26 Claims, 16 Drawing Sheets

INFANT SWING APPARATUS

CROSS-REFERENCE TO RELATED APPLICATION

This application claims priority to Chinese Patent Application No. 200910164914.0 filed on Jul. 29, 2009.

BACKGROUND OF THE INVENTION

1. Field of the Invention

The present invention relates to infant swing apparatuses with an adjustable backrest.

2. Description of the Related Art

A swing apparatus can provide regular swinging movements that help to comfort a young child or baby placed on the seat portion of the swing apparatus. Currently, most available swing apparatuses include electrically motorized actuators for driving the seat portion in movement. For controlling the swing apparatus, a caregiver has to operate a switch button usually provided on a side of the swing apparatus for adjusting the amplitude of the swinging movements that are imparted to the seat portion. Other possible adjustment of the swing apparatus includes changing the inclination of a backrest that is pivotally coupled with the seat. To adjust the inclination of the backrest, the user has to press laterally on two unlock buttons on left and right sides of the seat portion to unlock the backrest, and then use both hands for moving the seat.

The aforementioned design is not ergonomic and is inconvenient to operate for a caregiver. For example, the caregiver has to stand in proximity to the swing apparatus to control swing movements of the seat portion. In addition, the adjustment of the backrest is not convenient owing to the design of the unlock button. Moreover, the conventional swing apparatus usually does not have a canopy, or is provided with a canopy that is generally affixed on the support structure. As a result, when the seat performs swinging movements, the canopy may not provide effective shelter against light. Further, the canopy cannot be dismounted as desired.

Therefore, there is a need for an improved swing apparatus that can be fabricated in a cost-effective manner, and address at least the foregoing issues

SUMMARY

The present application describes an infant swing apparatus. In one embodiment, the infant swing apparatus comprises a support structure and at least one swing arm pivotally coupled with the support structure, a seat, including a backrest support tube, and a recline assembly connecting the seat with the swing arm. The recline assembly comprises a first coupling shell fixedly coupled with the backrest support tube, a second coupling shell fixedly coupled with the swing arm and pivotally assembled with the first coupling shell, a latch member assembled between the first and second coupling shell, wherein the latch member is movable along an axle of rotation between the first and second coupling shell, and an actuator mechanism operable to cause the latch member to move from a first position locking the first and second coupling shell with each other, to a second position unlocking the first coupling shell from the second coupling shell.

In other embodiments, the infant swing apparatus is electrically driven, and comprises a remote controller that allows to control the operation of the swing apparatus in a convenient manner.

In other variant embodiments, the infant swing apparatus can include a canopy that is assembled on the swing arms, and movable along with the swing arms.

At least one advantage of the infant swing apparatus described herein is the ability to provide a recline assembly that is operable to adjust an angular position of the seat for fitting a seating position of the infant. Because the operating button and the backrest support tube can rotate in a same plane about parallel axes of rotation during adjustment, the manual operation for unlocking the recline assembly and adjusting the backrest can be executed without effort in a more convenient manner. In addition, because the canopy is movable along with the swing arms, the canopy can provide effective sheltering above the seat.

DETAILED DESCRIPTION OF THE EMBODIMENTS

The present application describes an infant swing apparatus in which a seat is coupled with a recline assembly that is operable to adjust an recline position of the seat for fitting a seating position of the user. In certain embodiments, the infant swing apparatus may be electrically driven, and is equipped with a remote controller to facilitate the operation of the swing apparatus. In other variant embodiments, the swing apparatus may also be provided with a canopy that is detachably mounted on the swing arm.

Figure 1:
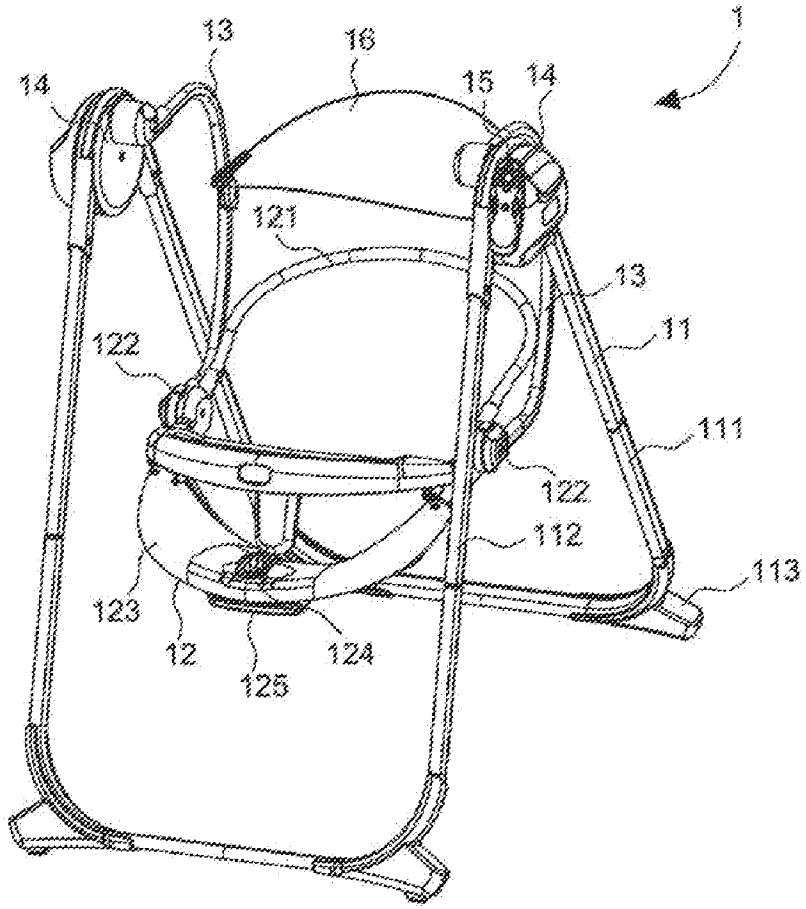
FIG. 1 is a perspective view illustrating one embodiment of an infant swing apparatus.
Figure 2:
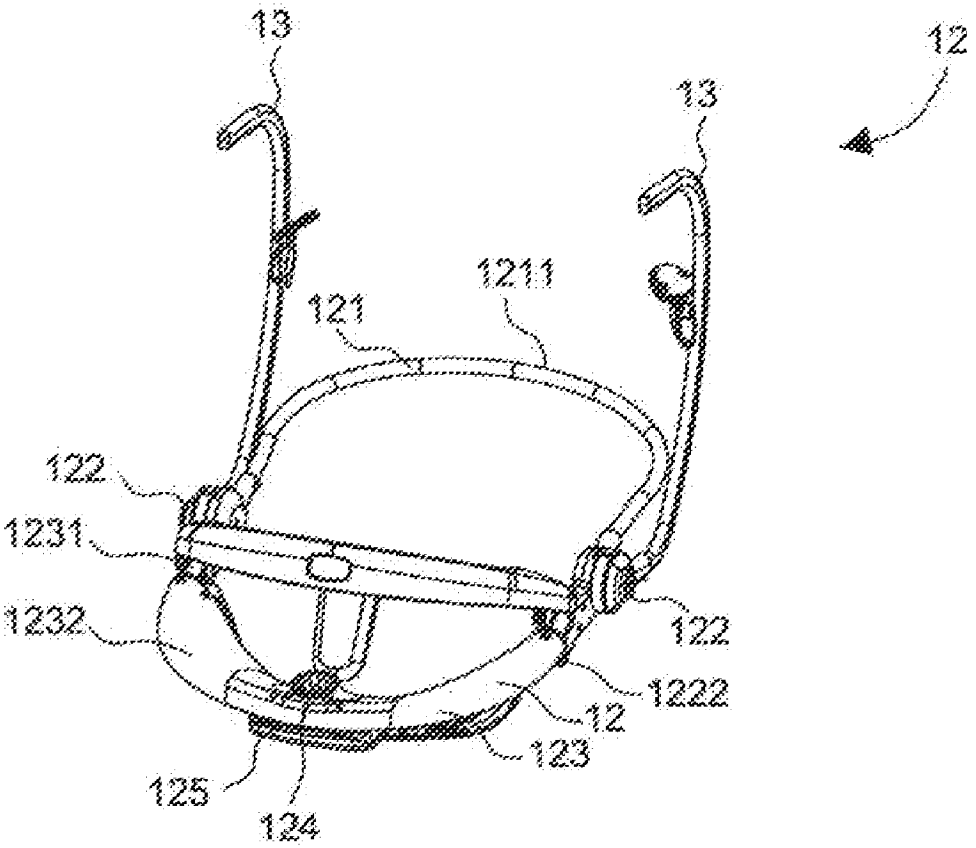
FIG. 2 is a perspective view illustrating a seat of the swing apparatus shown in FIG. 1.
Figure 3:
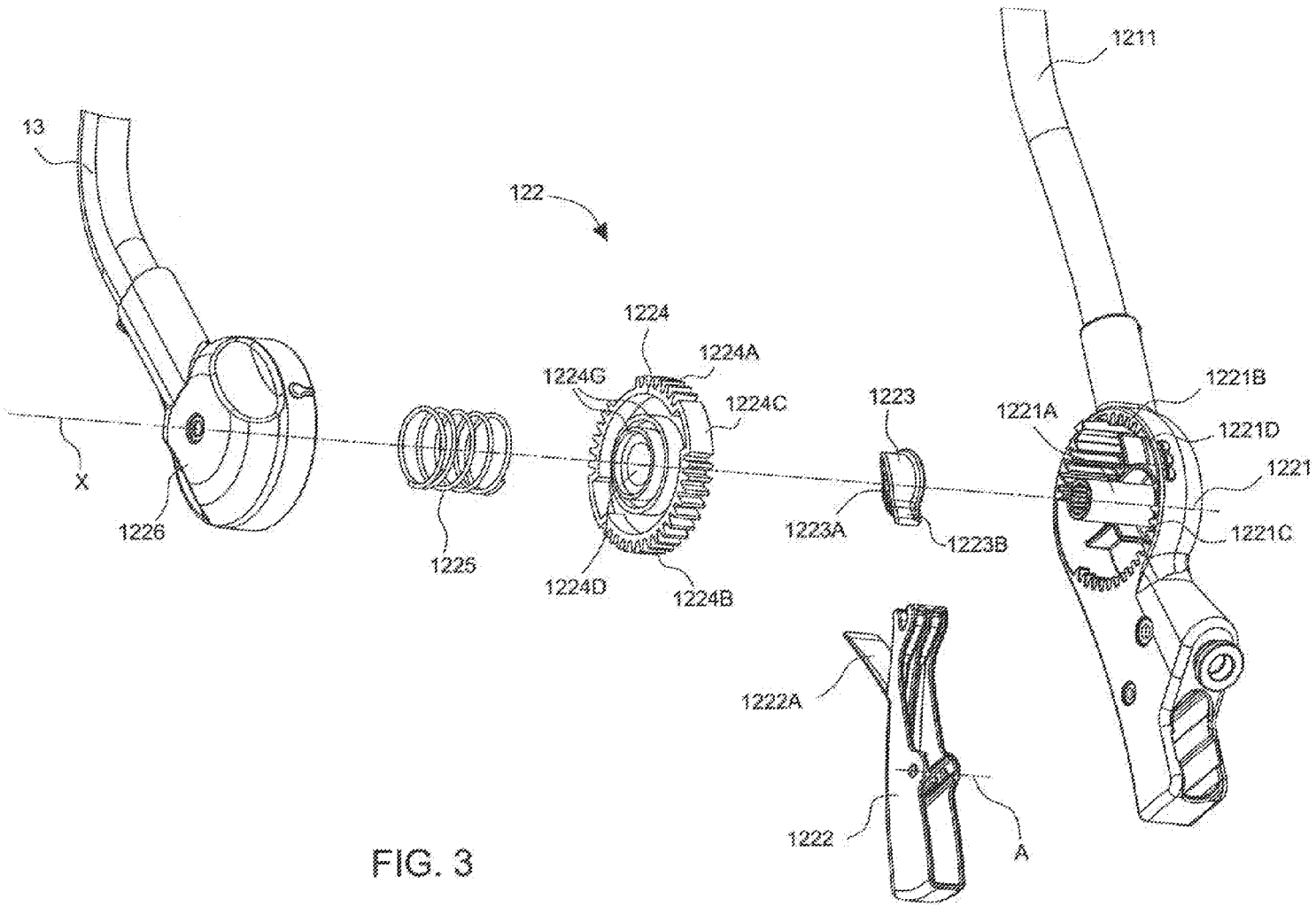
FIG. 3 is an exploded view illustrating the construction of one recline assembly used in the swing apparatus.

FIGS. 1 and 2 are perspective views respectively illustrating one embodiment of an infant swing apparatus 1. As shown, the infant swing apparatus 1 comprises a support frame 11, a seat 12, two swing arms 13 connected with two sides of the seat 12, two actuator mechanisms 14 respectively assembled between the swing arms 13 and the support frame 11, a remote controller 15 and a canopy 16. The seat 12 can be hung by the swing arms 13 at a height over the ground. The actuator mechanisms 14 can be operable to drive back and forth swinging movements of the seat 12.

As shown in FIG. 1, the support frame 11 can include two support legs 111 and 112. In one embodiment, the support legs 111 and 112 can be respectively formed with U-shaped tubular structures that have upper ends coupled each other at the actuator mechanisms 14. Feet 113 can also be affixed on lower ends of the legs 111 and 112 to provide stable resting contact of the legs 111 and 112 on the ground. In one embodiment, the support frame 11, support legs 111 and 112 and feet 113 can be made of metal, plastics or like rigid materials.

The seat 12 can include a backrest portion 121, two recline assemblies 122, a seating portion 123, a knob 124 and a vibrating apparatus 125. As shown in FIG. 2, the backrest portion 121 can include a backrest support tube 1211 having a generally U-shape. The seating portion 123 can also include a generally U-shaped seat support tube 1231, and a seat board 1232 affixed on the seat support tube 1231. The recline assemblies 122 are respectively provided on the left and right sides of the seat 12, joining with ends of the support tubes 1211 and 1231 and swing arms 13 for connecting together the backrest portion 121, seating portion 123 and the swing arms 13. The recline assemblies 122 are operable to lock the backrest portion 121 at multiple angular positions, and unlock for allowing angular adjustment of the backrest portion 121 relative to the seating portion 123 and swing arms 13. The knob 124 and vibration box 125 are provided on the seat board 1232. Switched by the knob 124, the vibration box 125 is operable to generate vibration that is transmitted to the seat 12 for adding extra comforting sensation to the child.

FIGS. 3-7 are schematic views illustrating the construction of one recline assembly 122. The recline assembly 122 comprises a first coupling shell 1221, an operating button 1222, a rotary member 1223, a latch member 1224, a spring 1225 and a second coupling shell 1226. The first and second coupling shells 1221 and 1226 are hollow casings that can assemble with each other to define an inner space in which the rotary member 1223, latch member 1224, and spring 1225 can be mounted. Moreover, the first and second coupling shells 1221 and 1226 respectively include shaft elements 1221A and 1226A that can assemble coaxial with each other to form a pivot connection between the first and second coupling shells 1221 and 1226. The operating button 1222 and rotary member 1223 form an actuator mechanism that is operable to drive movement of the latch member 1224 from a locked position to an unlocked position.

The left and right end portions of the backrest support tube 1211 are respectively fixed with an upper portion of each first coupling shell 1221, whereas the left and right end portions of the seat support tube 1231 are respectively fixed with a lower portion of each first coupling shell 1221. A distal end of each swing arm 13 is respectively fixed each second coupling shell 1226. Each first coupling shell 1221 can have an inner concave surface of a cylindrical shape provided with two sets of teeth 1221B and 1221C, and a restricting groove 1221D interposed between the two sets of teeth 1221B and 1221C. The restricting groove 1221D has a width that is larger than the respective pitch of the teeth 1221B and 1221C. Correspondingly, a cylindrical inner surface of each second coupling shell 1226 can also have an inner concave surface of a cylindrical shape provided with two sets of teeth 1226B and 1226C, and a restricting groove 1226D interposed between the two sets of teeth 1226B and 1226C.

The latch member 1224 has a generally circular shape provided with a central hole 1224D through which the shaft elements 1221A and 1226A can be assembled. The latch member 1224 is thereby movable along the axle defined by the shaft elements 1221A and 1226A (as shown by the arrow in FIG. 7), and the first coupling shell 1221 can rotate about the shaft element 1226A relative to the latch member 1224 and the second coupling shell 1226 for modifying an angular position of the backrest portion 121 relative to the swing arms 13. The latch member 1224 has an outer peripheral surface of a cylindrical shape provided with two sets of teeth 1224A and 1224B, and a rib 1224C interposed between the two sets of teeth 1224A and 1224B. The rib 1224C has a width that is larger than the respective pitch of the teeth 1224A and 1224B. The restricting groove 1226D of the second coupling shell 1226 can facilitate positioning of the rib 1224C of the latch member 1224, which can insert into the restricting groove 1221D of the first coupling shell 1221 when the latch member 1224 is in a locked state. The width of the restricting groove 1221D is larger than the rib 1224C. As the first coupling shell 1221 is adjusted and locked at different angular positions, the restricting groove 1221D can therefore receive the placement of the rib 1224C and one or more teeth 1224A and 1224B. Consequently, the range of adjustment for the first coupling shell 1221 can be defined by the width of the restricting groove 1221D. The teeth 1224A and 1224B of the latch member 1224 can respectively engage with the teeth 1221B and 1221C of the first coupling shell 1221 and the teeth 1226B and 1226C of the second coupling shell 1226 for locking with each other the first and second coupling shell 1221 and 1226.

As shown, a first side of the latch member 1224 facing the rotary member 1223 also includes a protrusion 1224E having an inclined surface 1224F. A second side of the latch member 1224 facing the spring 1225 includes concentric collars 1224G for anchoring the spring 1225.

The spring 1225 is interposed between the latch member 1224 and the second coupling shell 1226. More specifically, the spring 1225 may be mounted along the axis of the shaft elements 1221A and 1226A and has a first end anchored with the collars 1224G of the latch member 1224 and a second end anchored with an inner surface of the second coupling shell 1226.

Figure 4:
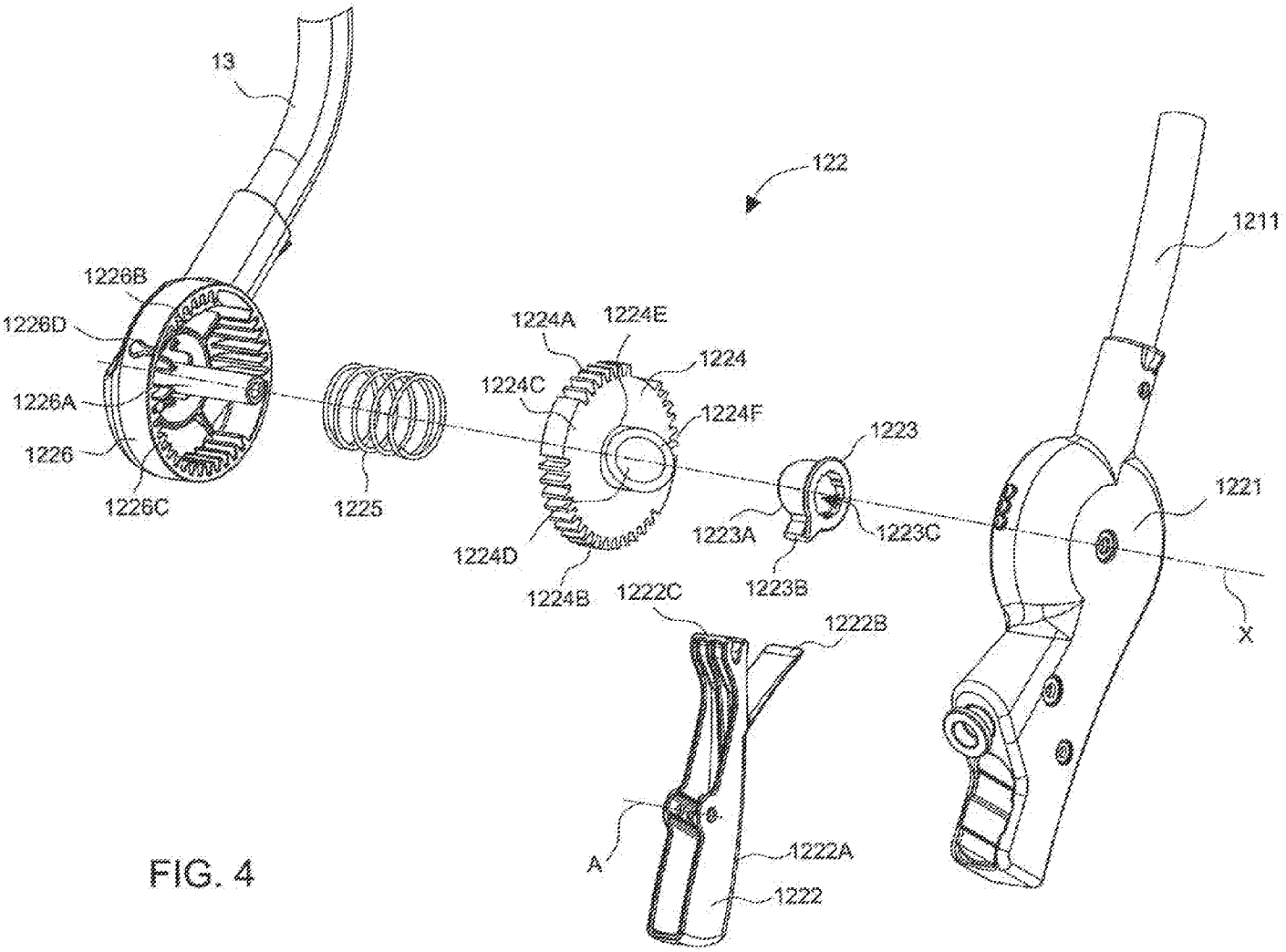
FIG. 4 is an exploded view illustrating the construction of the recline assembly of FIG. 3 in an opposite direction.
Figure 5:
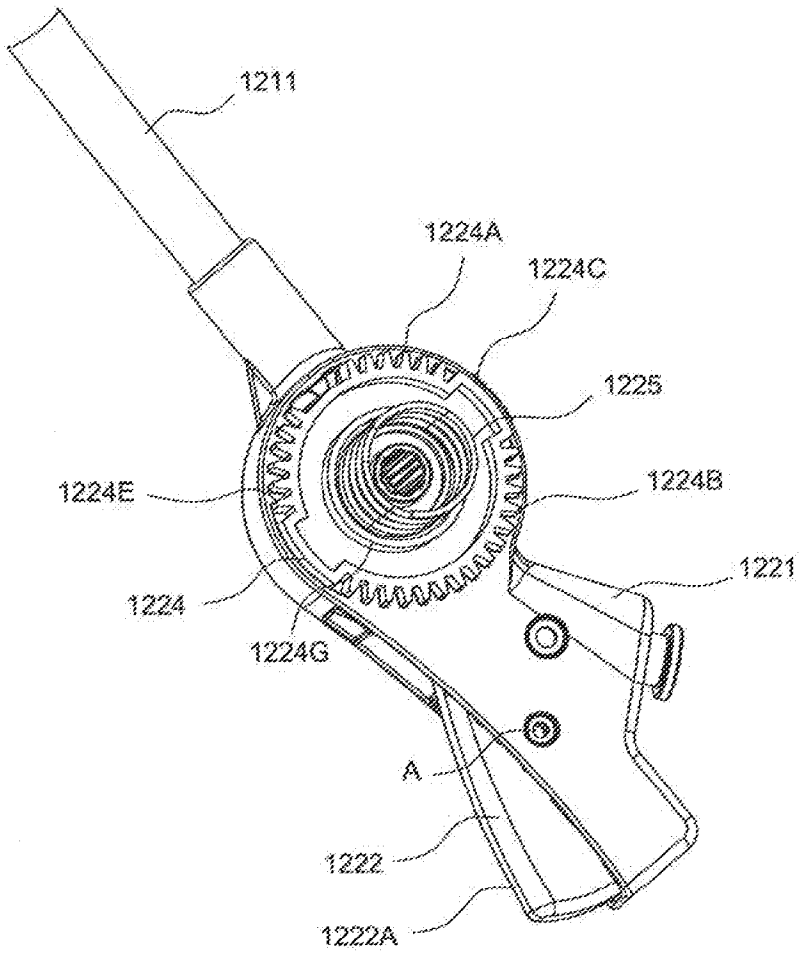
FIG. 5 is a schematic view illustrating the assembly of the spring and latch member relative to the first coupling shell.
Figure 6:
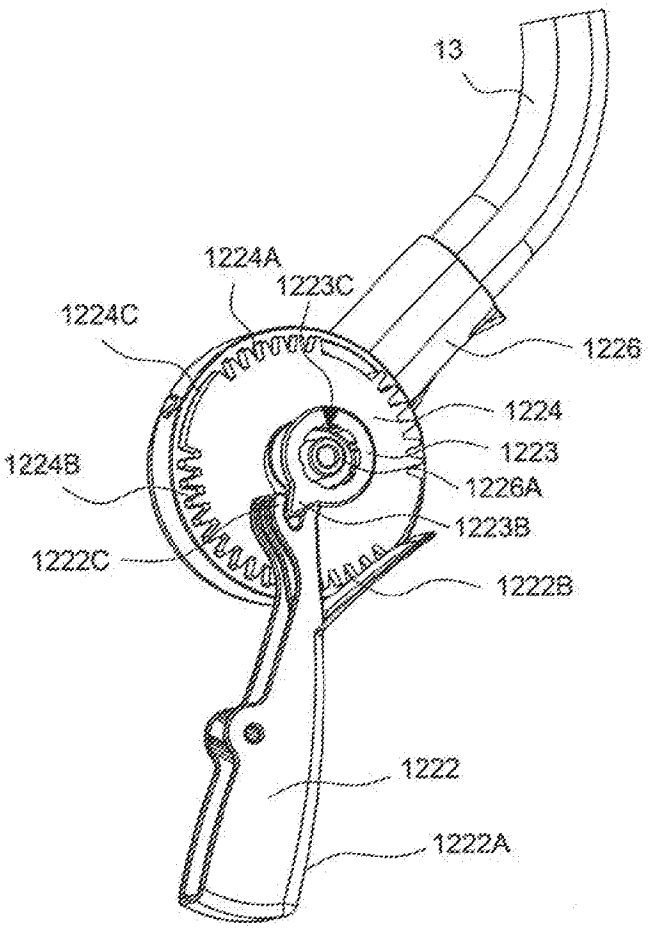
FIG. 6 is a schematic view illustrating the assembly of the operating button, rotary member and latch member relative to the second coupling shell.
Figure 7:
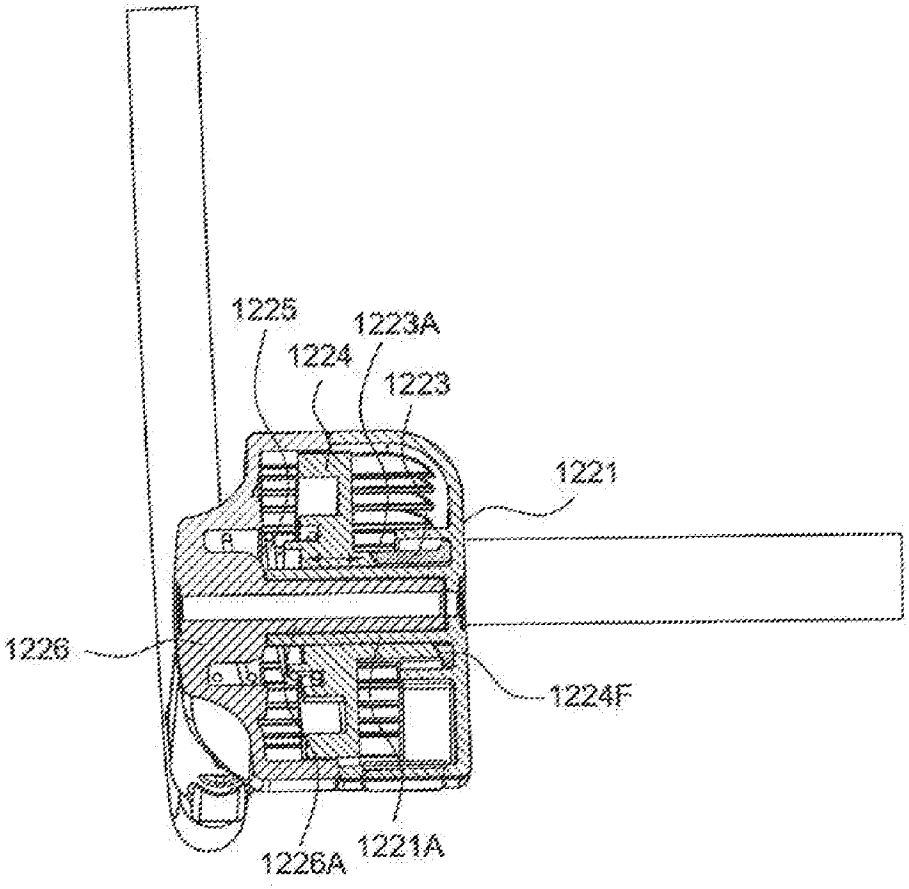
FIG. 7 is a cross-sectional view of the recline assembly.

As shown in FIGS. 4, 6 and 7, the rotary member 1223 is positioned at the side of the protrusion 1224E. The rotary member 1223 has a cylindrical portion with one side provided with an inclined surface 1223A, and a radial protrusion 1223B projecting from the lateral surface of the cylindrical portion, and a central hole 1223C. The inclined surface 1223A of the rotary member 1223 is in contact with the inclined surface 1224F of the latch member 1224, whereas the radial protrusion 1223B engages with the operating button 1222. The shaft element 1221A of the first coupling shell 1221 passes through the central hole 1223C of the rotary member 1223 such that the rotary member 1223 is pivotally assembled with the first coupling shell 1221. Accordingly, the rotary member 1223 can rotate about an axis of rotation that is the same as the axis of rotation X of the first coupling shell 1221 relative to the swing arm 13.

Figure 8:
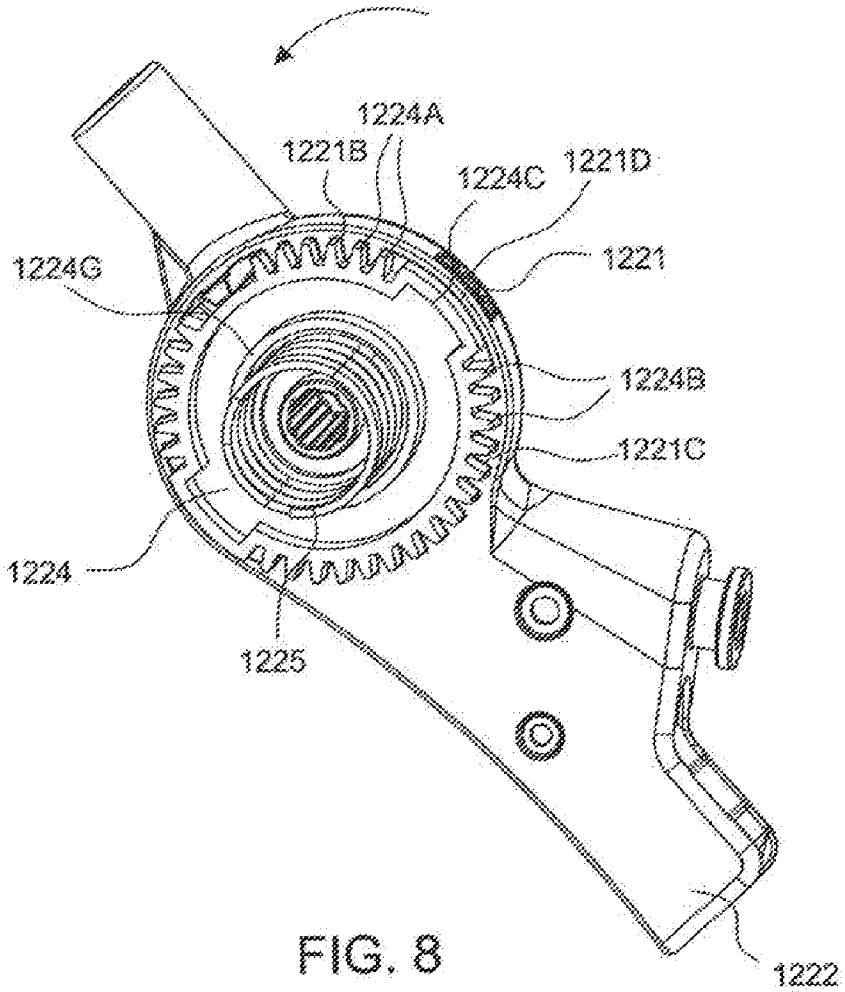
FIG. 8 is a schematic view showing the first coupling shell at a first angular position.

The operating button 1222 is assembled through the first coupling shell 1221, and comprises a push portion 1222A, and a resilient arm 1222B and abutting extension 1222C that are located opposite to the push portion 1222A. In one embodiment, the operating button 1222, including the push portion 1222A, resilient arm 1222B and abutting extension 1222C, can be formed in a single body by plastics molding. The operating button 1222 can be pivotally assembled with the first coupling shell 1221 by a pin or like pivot link, such that the operating button 1222 can rotate around a pivot axis A between the push portion 1222A and resilient arm 1222B. In the illustrated embodiment, the pivot axis A is parallel with the axis of rotation of the first coupling shell 1221 defined by the shaft element 1221A. The abutting extension 1222C can have a recessed surface in which the radial protrusion 1223B of the rotary member 1223 can engage. As shown in FIG. 8, once the operating button 1222 is assembled through the first coupling shell 1221, the push portion 1222A is located at a lower side of the recline assembly 122, and the operating button 1222, first coupling shell 1221 and backrest support tube 1211 can rotate in a same plane about parallel axes of rotation A and X (i.e., extending laterally from left to right) for facilitating adjustment operation of the backrest portion 121.

Figure 9:
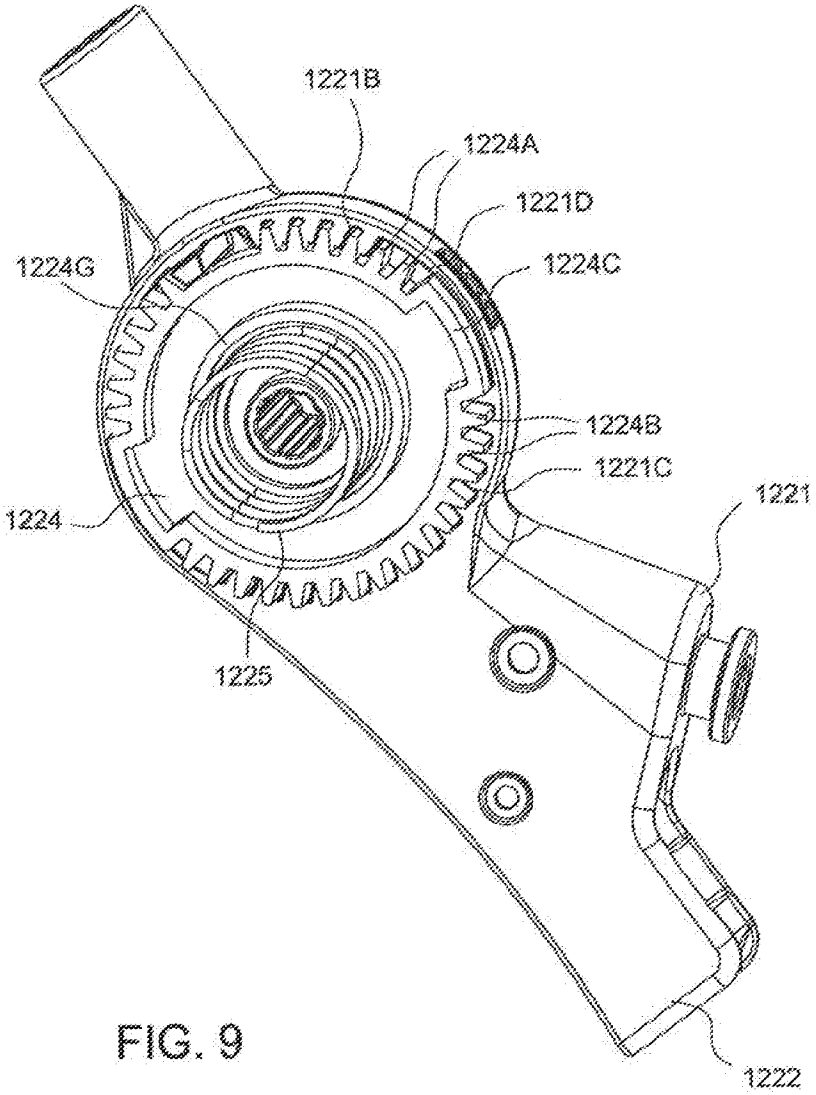
FIG. 9 is a schematic view showing the first coupling shell adjusted in an anticlockwise direction to a second angular position relative to the second coupling shell.

Exemplary adjustment operations of the backrest portion 121 are described hereafter with reference to FIGS. 4, 7, 8 and 9, wherein FIG. 8 schematically shows the first coupling shell 1221 at a first angular position, and FIG. 9 schematically shows the first coupling shell 1221 rotated anticlockwise to a second angular position relative to the second coupling shell 1226. For the sake of clarity, the second coupling shell 1226 is omitted in FIGS. 8 and 9, the change of position of the second coupling shell 1226 being associable with the change in position of the latch member 1224.

As shown in FIG. 8, when no pressing action is exerted on the operating button 1222, the elastic force of the spring 1225 urges the latch member 1224 toward the first coupling shell 1221. At this first position of the latch member 1224, the two sets of teeth 1224A and 1224B respectively engage with the teeth 1221B and 1221C of the first coupling shell 1221 and the teeth 1226B and 1226C of the second coupling shell 1226. In addition, the restricting groove 1221D of the first coupling shell 1221 can lodge the rib 1224C and one or more teeth 1224A and 1224B (FIG. 8 exemplary shows the restricting groove 1221D receiving the rib 1224C, one tooth 1224A at a left side thereof, and one tooth 1224B at a right side thereof). The first and second coupling shell 1221 and 1226 are thereby locked with each other via the latch member 1224, and the backrest portion 121 can be securely locked at a first angular position relative to the swing arms 13.

When a user wants to proceed to an angular adjustment, the push portion 1222A can be pressed to cause the operating button 1222 to rotate around the pivot axis A, which drives the rotary member 1223 in rotation via the engagement between the abutting extension 1222C and the radial protrusion 1223B. Owing to the pushing contact between the inclined surfaces 1223A and 1224F, the latch member 1224 consequently moves toward the second coupling shell 1226 to reach a second position where the teeth 1224A and 1224B and the rib 1224C respectively disengage from the teeth 1221B and 1221C and the restricting groove 1221D of the first coupling shell 1221. With the first coupling shell 1221 unlocked, the user can drive the backrest portion 121 to rotate (FIG. 8 exemplary shows an anticlockwise rotation) to a second angular position, whereas the latch member 1224 remain stationary retracted in the second coupling shell 1226. Once the backrest portion 121 reaches the desired angular position, the elastic force of the spring 1225 drives reverse movement of the latch member 1224 toward the first coupling shell 1221 until it reaches its initial locking position. The first coupling shell 1221 and backrest portion 121 can be thereby locked in the second angular position, as shown in FIG. 9.

It is worth noting that the number of teeth 1224A and 1224B received in the restricting groove 1221D varies as the first coupling shell 1221 is locked at different angular positions (FIG. 9 exemplary shows the restricting groove 1221D receiving the rib 1224C and two teeth 1224A at the left side of the rib 1224C). Accordingly, the range of angular adjustment for the first coupling shell 1221 and backrest portion 121 can be defined by the width of the restricting groove 1221D. In one embodiment, the width of the restricting groove 1221D can be set to receive the rib 1224C and a maximum of two teeth 1224A for defining a range of three adjustable angular positions. In other embodiments, the width of the restricting groove 1221D can be set to receive the rib 1224C and a maximum of four teeth 1224A for defining a range of five adjustable angular positions.

In the embodiment shown, the seat support tube 1231 of the seating portion 123 is affixed on a lower end of the first coupling shell 1221. When the swing apparatus 1 is used, the operating button 1222 can be pressed at the same time as the recline assembly 122 is driven in rotation for adjusting the angular position of the seat 12 relative to the swing arms 13. As a result, the swing apparatus 1 can be adjusted in a flexible manner to provide optimal comfort of use. Moreover, because the operating button 1222 is provided at a lower end on each left and right side of the seat 12, the user can press on the operating button 1222 and, at the same time, grasp and rotate the first coupling shell 1221 relative to the second coupling shell 1226, which facilitates the adjustment operation. In alternate embodiments, the seat support tube 1231 can also be affixed on a lower end of the second coupling shell 1226, and only the backrest portion 121 can proceed to angular adjustment relative to the swing arms 13.

Figure 10:
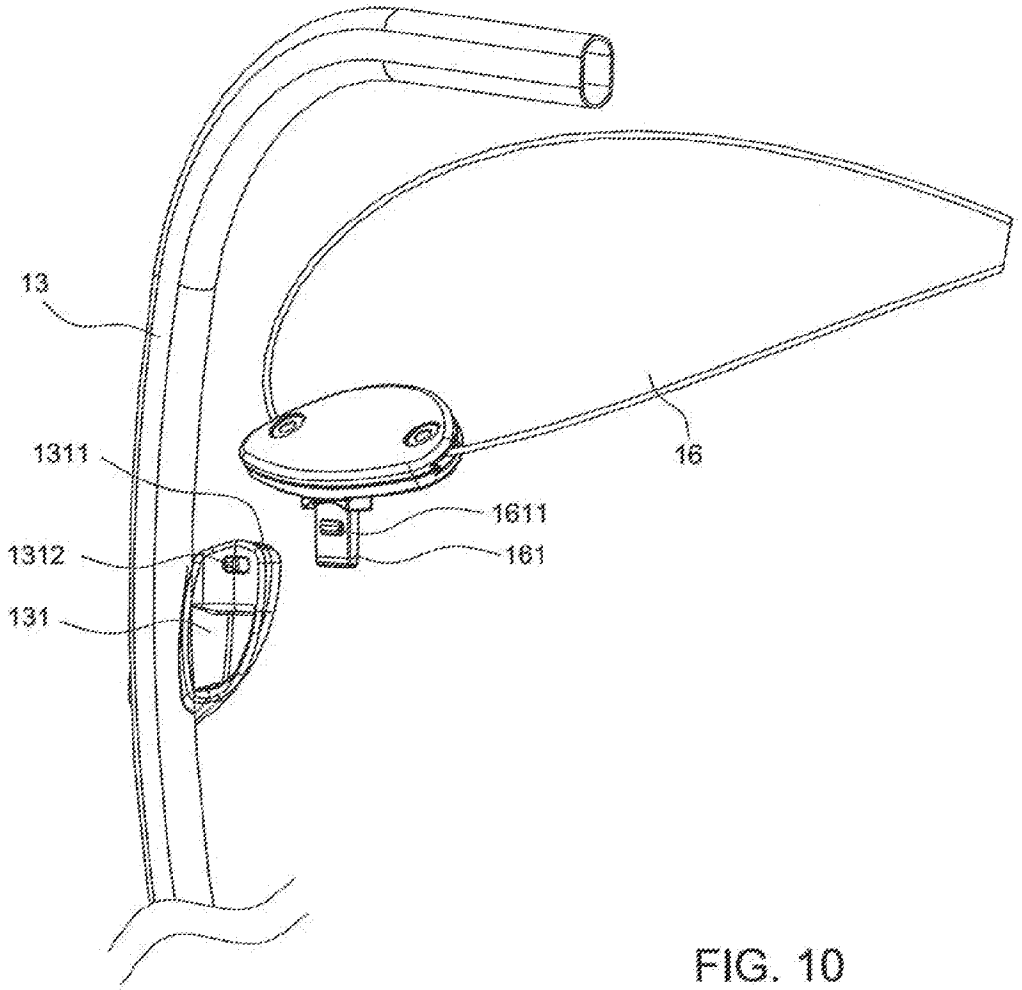
FIG. 10 is a schematic view illustrating the assembly of a canopy on the swing apparatus.
Figure 17:
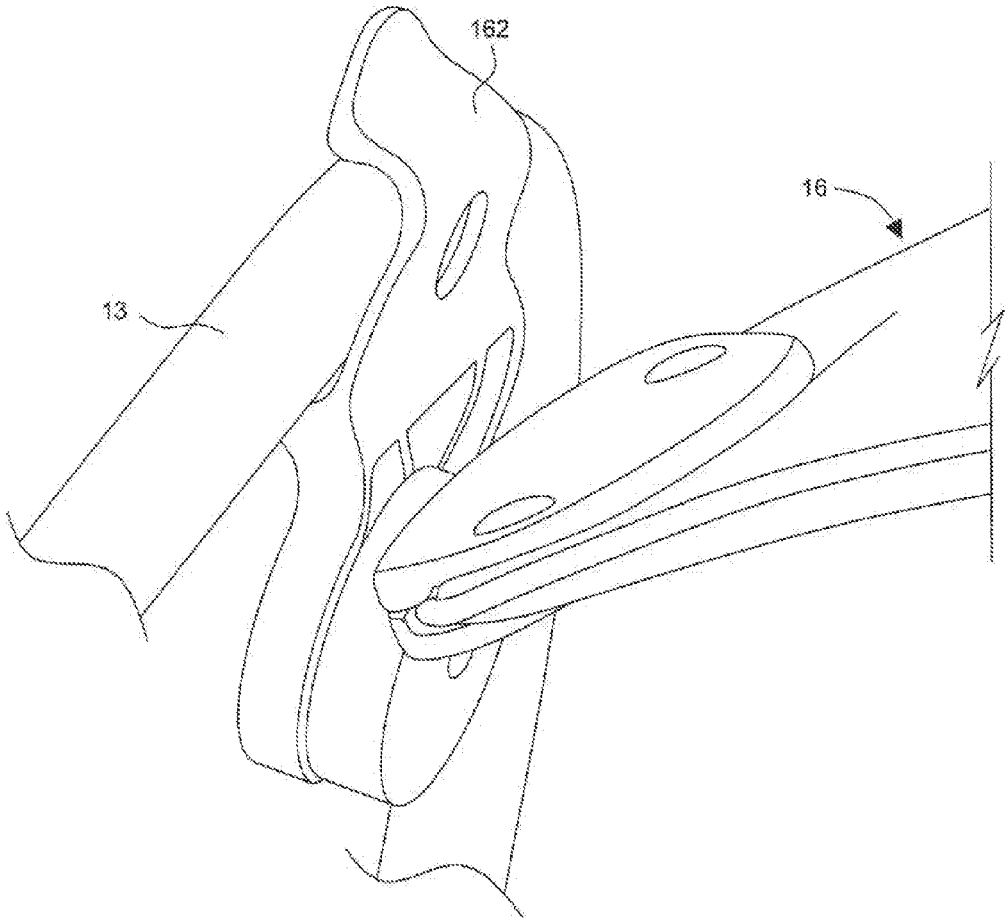
FIG. 17 is a schematic view illustrating another embodiment of the canopy assembly on a swing apparatus.

In conjunction with FIGS. 1 and 2, FIG. 10 is a schematic view illustrating the assembly of the canopy 16 on one swing arm 13 of the swing apparatus 1. For mounting the canopy 16, a canopy fixture 131 is provided on a portion of the swing arm 13 located above the backrest portion 121. The canopy fixture 131 may include an insertion slot 1311 having an inner sidewall provided with a through-hole 1312. In turn, one side of the canopy 16 may include at least one plug 161 adapted to engage through the canopy fixture 131 for locking the canopy 16 in position. More specifically, when the plug 161 is inserted into the insertion slot 1311 for assembling the canopy 16, a latching stud 1611 protruding from a sidewall of the plug 161 can engage through the through-hole 1312 for fastening the plug 161 with the canopy fixture 131. The canopy 16 is thereby fixedly secured on the swing arm 13, and can move along with the swing arm 13 for offering constant coverage even when the seat 12 is swung. With such installation, the infant placed on the seat 12 can enjoy more comfort as the canopy 16 move along with swinging movements of the seat 12. When the canopy 16 is not needed, a user can press the latching stud 1611 to have it disengaged from the through-hole 1312, and the canopy 16 can be then removed from swing arms 13. It is worth noting that other connection structures may be used for mounting the canopy on the swing arms of the swing apparatus. In the variant example shown in FIG. 17, two sides of the canopy 16 can have C-shaped clipper element 162 that can directly clamp on a tubular portion of each corresponding swing arm 13. With the clipper element 162, the canopy 16 can be easily fastened or detached from the swing arms 13 without the need of a canopy fixture.

Figure 11:
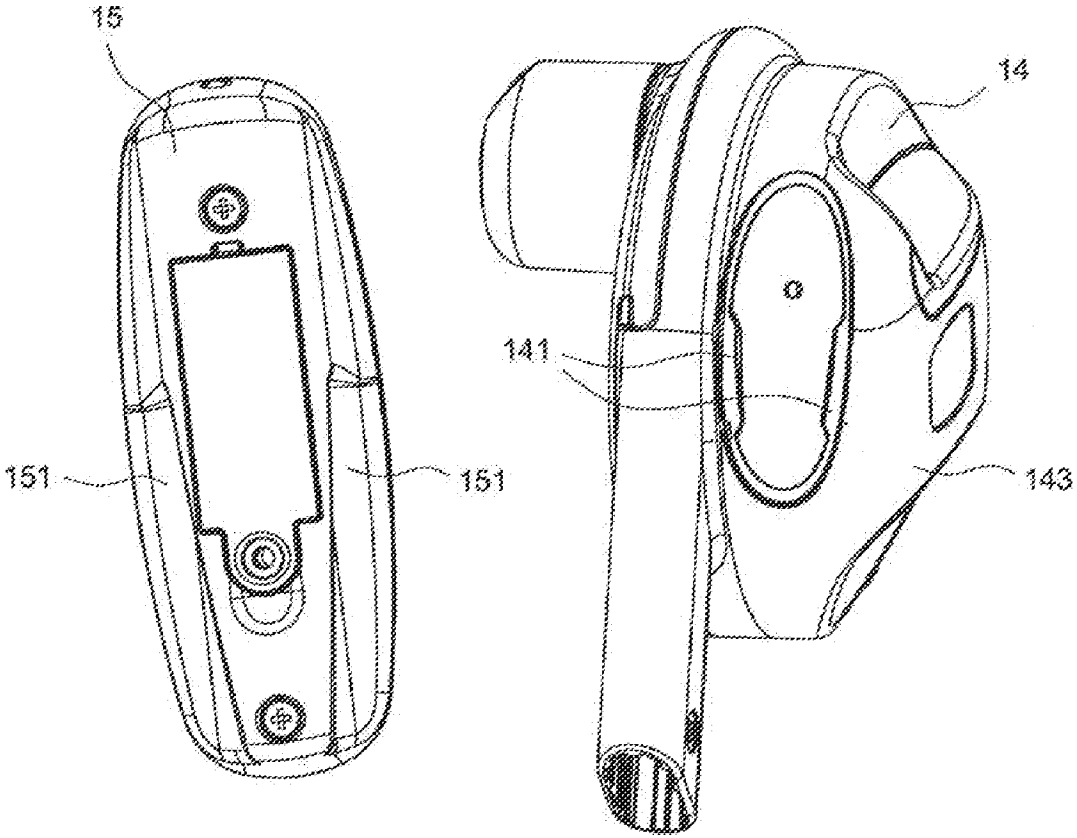
FIG. 11 is a schematic view illustrating the placement of a remote controller on the swing apparatus.

FIG. 11 is a schematic view illustrating the placement of the remote controller 15. As shown, one actuator mechanism 14 can be respectively installed between an upper end of each swing arm 13 and the corresponding side of the support frame 11 for driving swinging movement of the swing arms 13 relative to the support frame 11. The actuator mechanism 14 can comprise a driving circuit for driving the actuator mechanisms 14, and a wireless signal receiver circuit adapted to receive wireless signals transmitted from the remote controller 15 and issue control signals to the driving circuit for activating or deactivating the operation of the actuator mechanism 14. The wireless signals can include infrared, radio-frequency (RF) or like wireless signals. As shown in FIG. 11, the actuator mechanism 14 can include a housing 143 on which are formed two opposite restraining ribs 141, whereas the remote controller 15 can include two locking slots 151. When the remote controller 15 is not used, the ribs 141 can fit with the locking slots 151 for holding the remote controller 15 on the actuator mechanism 14. Provided with a remote controller 15, the swing movements of the swing apparatus 1 can be remotely controlled.

Figure 12:
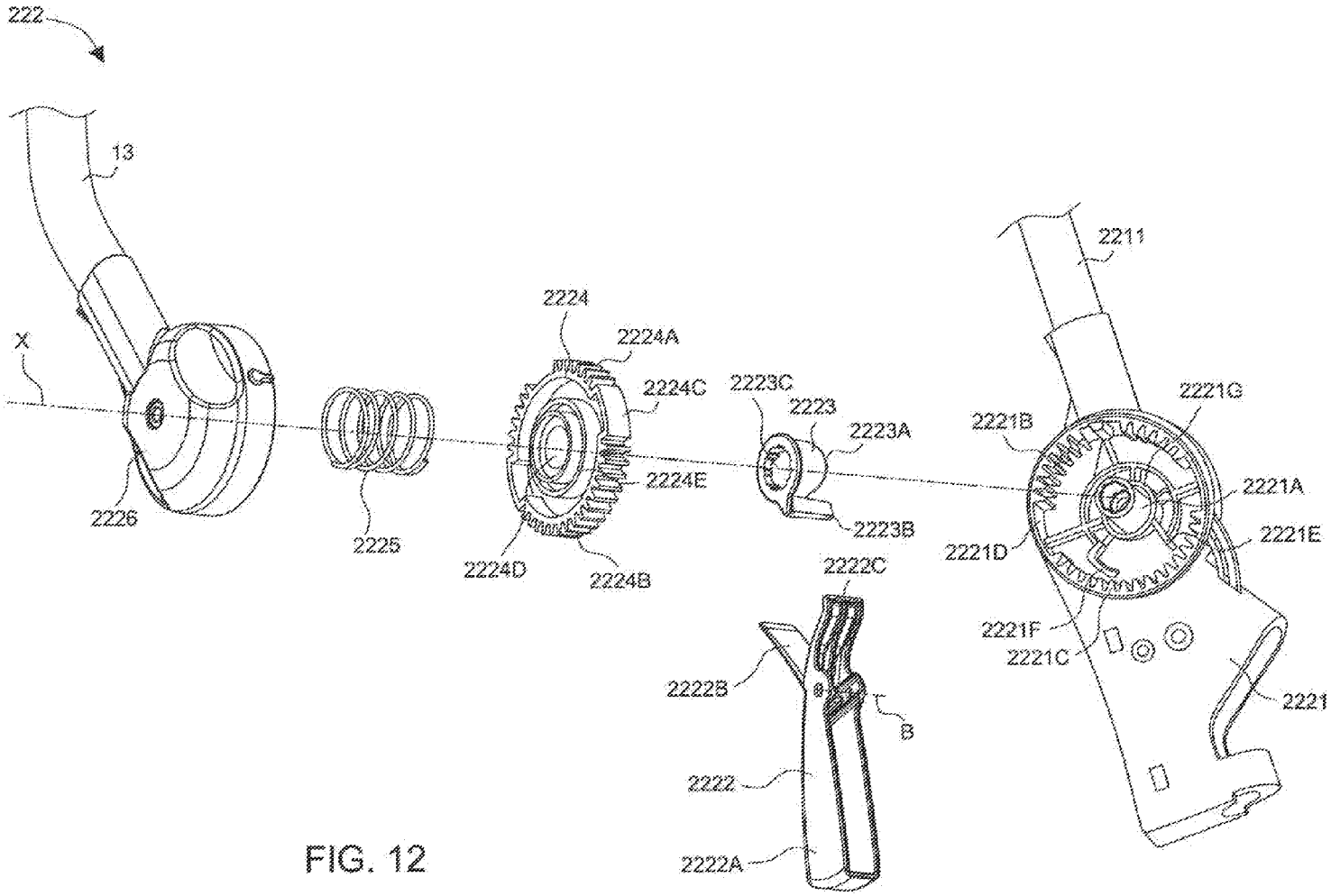
FIG. 12 is an exploded view illustrating another embodiment of a recline assembly.
Figure 13:
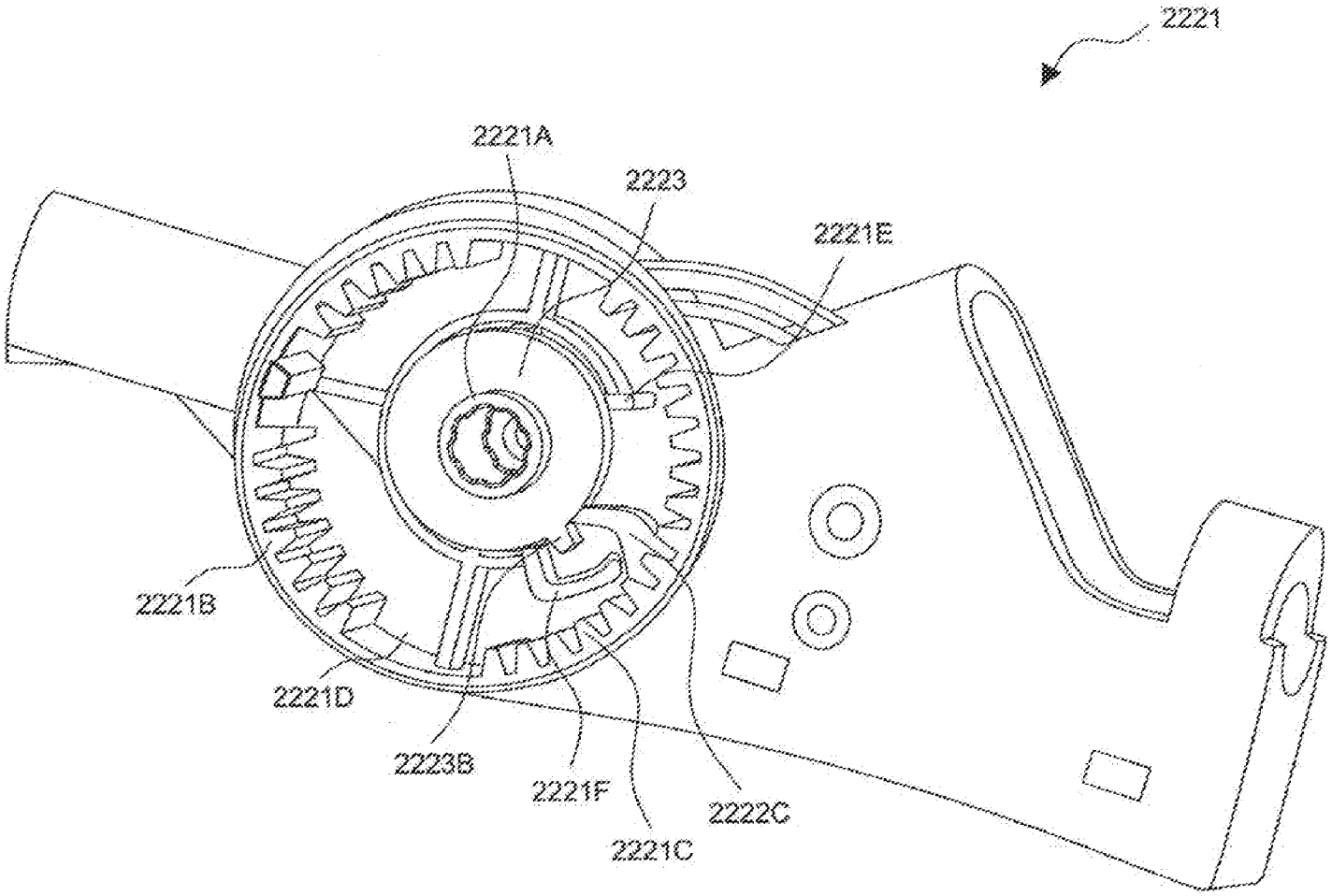
FIGS. 13 and 14 are schematic views respectively illustrating the structure of a first and second coupling shell used in the recline assembly shown in FIG. 12.
Figure 14:
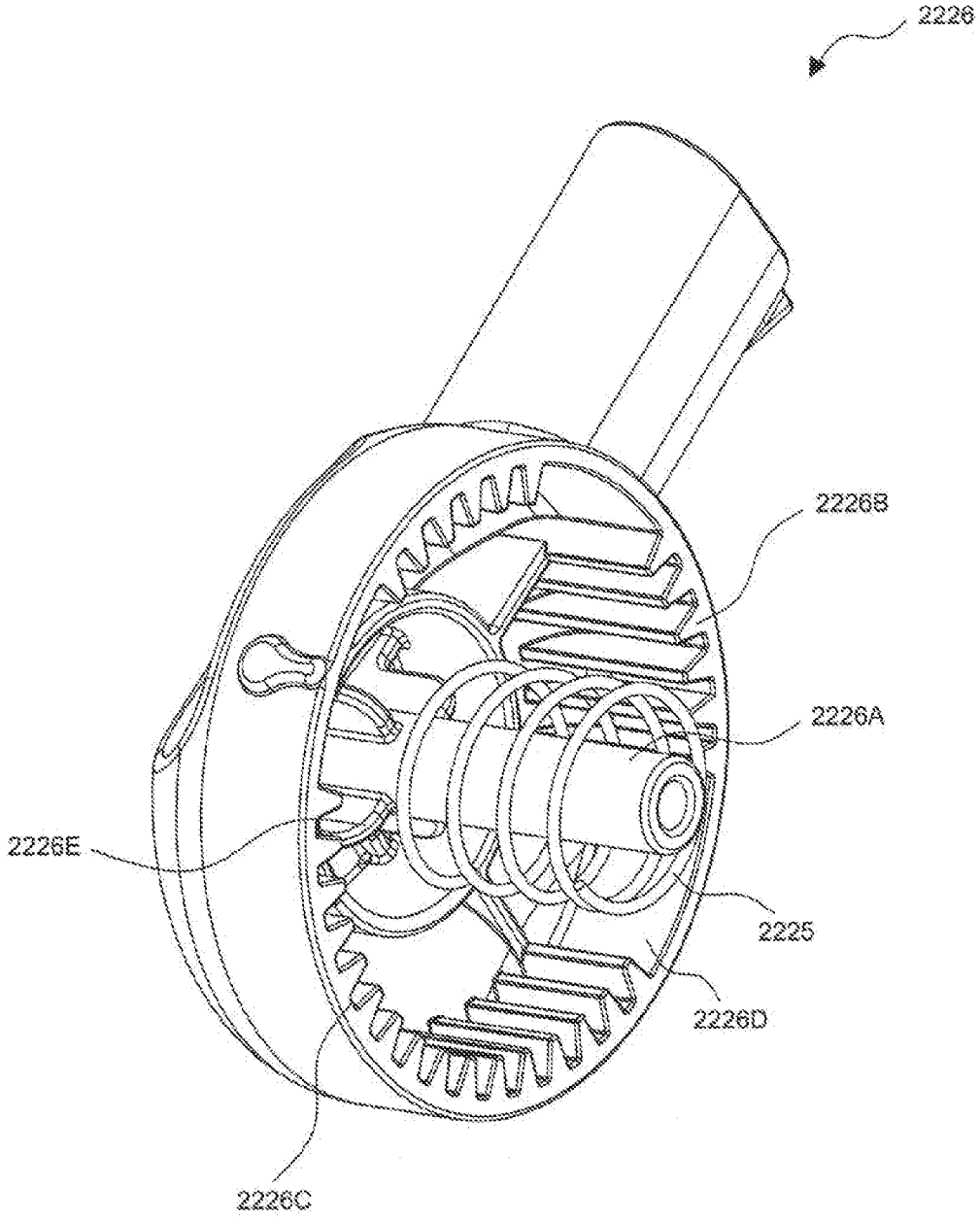

At least one advantage of the swing apparatus described herein is the ability to provide a recline assembly that allows convenient angular adjustment of a backrest portion of the seat. While the aforementioned description has depicted certain specific embodiments, the same advantages may be obtained with other construction of the recline assembly, as illustrated in FIGS. 12 through 14. FIG. 12 is an exploded view illustrating another embodiment of a recline assembly 222, and FIGS. 13 and 14 are schematic views respectively illustrating the structure of a first and second coupling shell 2221 and 2226 implemented in the recline assembly 222. As shown in FIG. 12, the recline assembly 222 can comprise a first coupling shell 2221 connected with a backrest support tube 2211, an operating button 2222, a rotary member 2223, a latch member 2224, a spring 2225, and a second coupling shell 2226 connected with one swing arm 23.

Referring to FIGS. 12 and 13, an inner side of the first coupling shell 2221 includes a protruding shaft element 2221A that can be mounted through the rotary member 2223, two sets of teeth 2221B and 2221C distributed on an inner cylindrical surface centered on the shaft element 2221A, two ribs 2221E and 2221F at different radial direction on the same inner cylindrical surface, and an inclined surface 2221G formed at the distal end of a collar portion in proximity around the shaft element 2221A. A restricting groove 2221D can be provided between the two sets of teeth 2221B and 2221C, the restricting groove 2221D having a width larger than the he respective pitch of the teeth 2221B and 2221C.

Like the previous embodiment, the operating button 2222 and rotary member 2223 form an actuator mechanism that is operable to drive movement of the latch member 2224 from a locked position to an unlocked position. As shown in FIG. 12, the rotary member 2223 has a cylindrical portion with one side provided with an inclined surface 2223A, a radial protrusion 2223B projecting from the lateral surface of the cylindrical portion, and a central hole 2223C. The rotary member 2223 is installed by passing the shaft element 2221A through the central hole 2223C and having the inclined surface 2223A contact with the inclined surface 2221G of the first coupling shell 2221, whereas the radial protrusion 2223B is put in contact with a portion of the operating button 2222. Accordingly, the rotary member 2223 can rotate about an axis X of rotation that is the same as the axis of rotation of the first coupling shell 2221 relative to the swing arm 23.

The operating button 2222 is assembled through the first coupling shell 2221, and comprises a push portion 2222A, and a resilient arm 2222B and an abutting extension 2222C that are located opposite to the push portion 2222A. In one embodiment, the operating button 2222, including the push portion 2222A, resilient arm 2222B and abutting extension 2222C, can be formed in a single body by plastics molding. The operating button 2222 can be pivotally assembled with the first coupling shell 2221 by a pin or like pivot link, such that the operating button 2222 can rotate around a pivot axis B, the abutting extension 2222C being kept in contact with the radial protrusion 2223B.

Referring to FIG. 14, an inner side of the second coupling shell 2226 can also include a protruding shaft element 2226A, two sets of teeth 2226B and 2226C distributed on an inner cylindrical surface centered on the shaft element 2226A, a restricting groove 2226D placed between the two sets of teeth 2226B and 2226C, and a plurality of ribs 2226E protruding from the shaft element 2226A proximate to the bottom of the second coupling shell 2226. The ribs 2226E provide an anchor structure for connecting one end of the spring 2225, the other opposite end of the spring 2225 being anchored against the latch member 2224.

The latch member 2224 has an outer peripheral surface of a cylindrical shape provided with two sets of teeth 2224A and 2224B, and at least a rib 2224C interposed between the two sets of teeth 2224A and 2224B, the rib 2224C having a width greater than the pitch of the teeth 2224A and 2224B. The latch member 2224 is also provided with a central hole 2224D through which the shaft elements 2221A and 2226A can be assembled. More specifically, the shaft element 2221A can be passed through the central hole 2223C of the rotary member 2223 and the central hole 2224D of the latch member 2224, and the shaft element 2226A of the second coupling shell 2226 can be then assembled through the central hole of the shaft element 2221A of the first coupling shell 2221 for coupling the first and second coupling shell 2221 and 2226 with each other. Once assembled, the rib 2224C of the latch member 2224 is positioned in the restricting groove 2226D and can insert into the corresponding restricting groove 2221D of the first coupling shell 2221. The side surface of the latch member 2224 oriented toward the second coupling shell 2226 also includes two concentric collar 2224E for anchoring one end of the spring 2225, the other end of the spring 2225 being secured with the ribs 2226E of the second coupling shell 2226.

Figure 15:
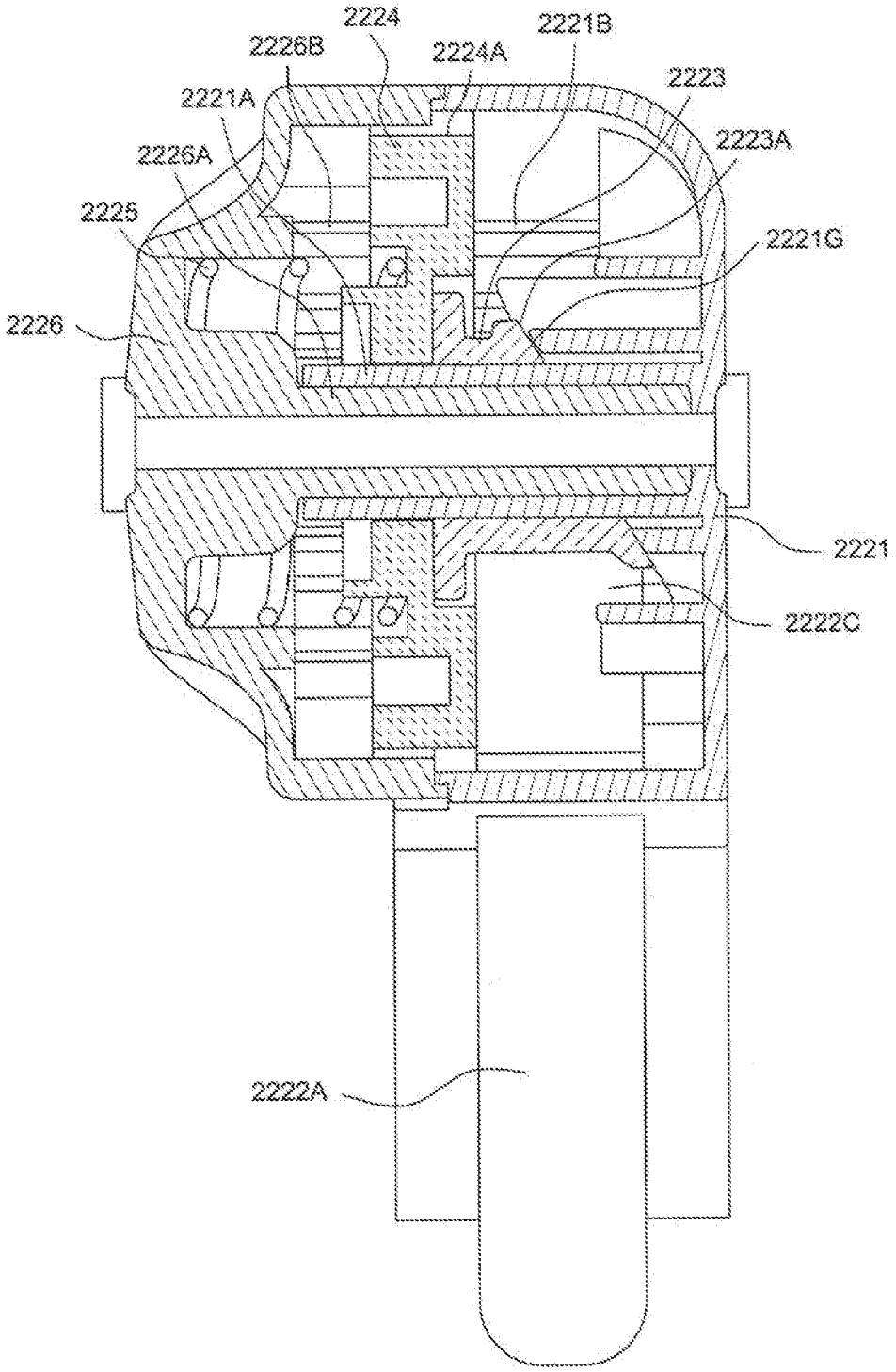
FIG. 15 is a cross-sectional view illustrating the recline assembly of FIG. 12 in a locked state.

FIG. 15 is a schematic view illustrating the recline assembly 222 in a locked state. In the locked state, the latch member 2224 is biased by the spring 2225 to a first position in which the teeth 2224A and 2224B respectively engage with the teeth 2221B and 2221C of the first coupling shell 2221 and the teeth 2226B and 2226C of the second coupling shell 2226. The first and second coupling shells 2221 and 2226 are thereby locked with each other to block rotation of the swing arm 23 relative to the backrest support tube 2211.

Figure 16:
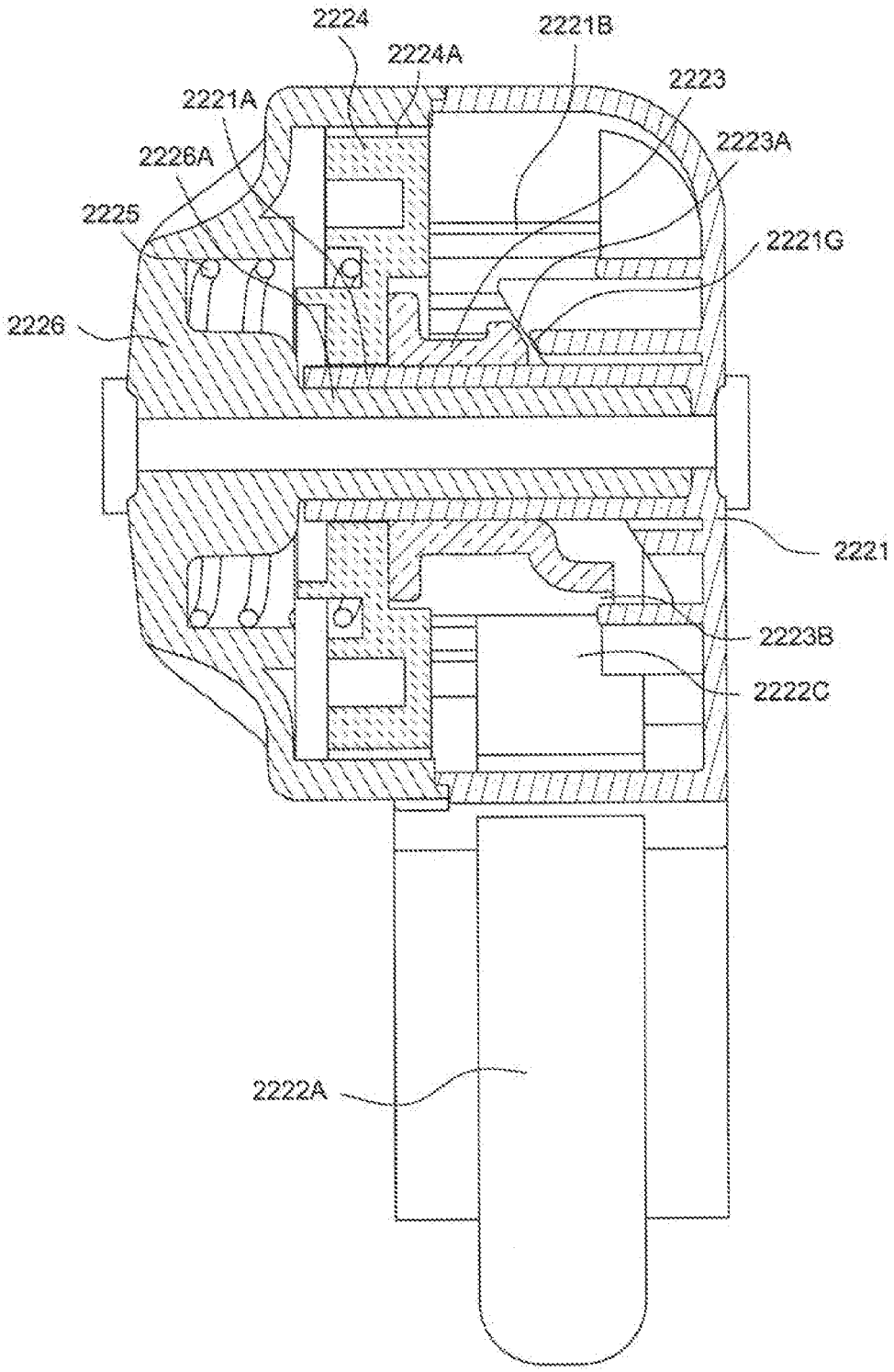
FIG. 16 is a cross-sectional view illustrating the recline assembly of FIG. 12 in an unlocked state.

FIG. 16 is a schematic view illustrating the recline assembly 222 in an unlocked state. When a user presses on the push portion 2222A of the operating button 2222, the abutting extension 2222C is driven in rotation until it contacts with the rib 2221F and causes the rotary member 2223 to rotate. As the rotary member 2223 rotates, the inclined surface 2223A of the rotary member 2223 also rotates in contact with the inclined surface 2221G of the first coupling shell 2221. The interaction between the inclined surfaces 2221G and 2223A in contact with each other pushes the rotary member 2223 and the latch member 2224 toward the second coupling member 2226 until the latch member 2224 reaches a second position disengaged from the first coupling shell 2221. The recline assembly 222 is thereby unlocked, and the second coupling shell 2226 and swing arm 23 coupled thereto can be rotated relative to the first coupling shell 2221 and backrest support tube 2211 for adjustment.

Once the pressure action on the operating button 2222 is released, the resilient arm 2222B can urge the operating button 2222 to rotate until the abutting extension 2222C contact with the ribs 2221E, whereas the spring 2225 can act to push the latch member 2224 and rotary member 2223 back toward the first coupling shell 2221 until the latch member 2224 reaches the first position engaged with the first and second coupling shell 2221 and 2226. The swing arm 23 and the backrest support tube 2211 are thereby locked with each other in the desired position.

According to the design needs, it will be readily appreciated that the embodiment illustrated in FIG. 16 can also incorporate a canopy 16, actuator mechanisms 14 and remote controller 15 as described previously.

At least one advantage of the infant swing apparatus described herein is the ability to provide a recline assembly that is operable to adjust an angular position of the seat for fitting a seating position of the infant. Because the operating button and the backrest support tube can rotate in a same plane about parallel axes of rotation during adjustment, the manual operation for unlocking the recline assembly and adjusting the backrest can be executed without effort in a more convenient manner.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. An infant swing apparatus comprising:

a support structure and at least one swing arm pivotally coupled with the support structure;

a seat including a seating portion and a backrest portion; and a recline assembly connecting the seat with the swing arm, wherein the recline assembly comprises:

a first coupling shell fixedly coupled with the backrest portion;

a second coupling shell fixedly coupled with the swing arm and pivotally assembled with the first coupling shell;

a latch member assembled between the first and second coupling shell, wherein the latch member is movable along an axis of rotation of the first coupling shell relative to the second coupling shell; and an actuator mechanism including an operating button operable to cause the latch member to move from a first position locking the first and second coupling shell with each other, to a second position unlocking the first coupling shell from the second coupling shell, wherein the operating button is rotatable about a pivot axis that is substantially parallel to the axis of rotation of the first coupling shell relative to the second coupling shell.

2. The swing apparatus according to claim 1, wherein a portion of the first coupling shell opposite to the side of the backrest portion is coupled with the seating portion.

3. The swing apparatus according to claim 1, wherein the operating button and the first coupling shell are operable to rotate in a same plane.

4. The swing apparatus according to claim 1, wherein the recline assembly further comprises a rotary member connected with the operating button, when the operating button is operated, the rotary member rotates to move the latch member from the first position toward the second position.

5. The swing apparatus according to claim 4, wherein the rotary member has a first inclined surface, and either of the latch member and the first coupling shell has a second inclined surface that is in contact with the first inclined surface.

6. The swing apparatus according to claim 4, wherein the rotary member when in rotation movement slides along the axis of rotation to push the latch member toward the second position.

7. The swing apparatus according to claim 1, wherein the latch member is biased toward the first position by a spring.

8. The swing apparatus according to claim 1, wherein an outer peripheral edge of the latch member includes a plurality of first teeth and a radial rib, an inner surface of the first coupling shell includes plurality of second teeth and a restricting groove, the restricting groove has a width greater than the radial rib such that the restricting groove is adapted to receive the radial rib and at least one of the first teeth.

9. The swing apparatus according to claim 1, wherein the operating button is facing downward relative to the seat.

10. The swing apparatus according to claim 1, wherein the seating portion includes a seat support tube that is affixed with the second coupling shell.

11. The swing apparatus according to claim 1, wherein the backrest portion includes a backrest support tube, and the first coupling shell is fixedly coupled with the backrest support tube.

12. The swing apparatus according to claim 1, wherein the operating button and the first coupling shell are operable to rotate in substantially parallel planes.

13. A swing apparatus comprising:

a support structure;

at least one swing arm pivotally coupled with the support structure and operable to swing relative to the support structure;

a seat connected with the swing arm; and a canopy having one side connected with the swing arm, whereby the canopy is movable along with the swing arm relative to the support structure;

wherein the swing arm includes a fixture socket, and the side of the canopy has a plug detachably inserted into the fixture socket for detachably securing the canopy with the swing arm.

14. The swing apparatus according to claim 13, wherein the side of the canopy includes a C-shaped clipper element detachably clamping on the swing arm.

15. An infant swing apparatus comprising:

a support structure;

at least one swing arm pivotally coupled with the support structure;

a seat including a seating portion and a backrest portion; and a recline assembly connecting the seat with the swing arm, wherein the recline assembly comprises:

a first coupling shell fixedly coupled with the seat;

a second coupling shell fixedly coupled with the swing arm and pivotally assembled with the first coupling shell;

a latch member assembled between the first and second coupling shell and movable between a first and second position, wherein the latch member when in the first position engages with the first and second coupling shell for blocking rotation of the first coupling shell relative to the second coupling shell, and the latch member when in the second position disengages from either of the first and the second coupling shell for allowing rotation of the first coupling shell relative to the second coupling shell; and an operating button facing downward relative to the backrest portion, the operating button being operable to cause the latch member to move from the first position to the second position.

16. The swing apparatus according to claim 15, wherein the backrest portion includes a backrest support tube, and the first coupling shell is fixedly coupled with the backrest support tube.

17. The swing apparatus according to claim 16, wherein a portion of the first coupling shell opposite to the side of the backrest support tube is coupled with the seating portion.

18. The swing apparatus according to claim 15, wherein the operating button and the first coupling shell are operable to rotate in a same plane about parallel axes of rotation.

19. The swing apparatus according to claim 15, wherein the operating button and the first coupling shell are operable to rotate in substantially parallel planes.

20. The swing apparatus according to claim 15, wherein the recline assembly further comprises a rotary member connected with the operating button, when the operating button is operated, the rotary member rotates to move the latch member from the first position toward the second position.

21. The swing apparatus according to claim 20, wherein the first coupling shell is operable to rotate relative to the second coupling shell about an axis of rotation, and the rotary member when in rotating movement slides along the axis of rotation to push the latch member toward the second position.

22. The swing apparatus according to claim 20, wherein the rotary member has a first inclined surface, and either of the latch member and the first coupling shell has a second inclined surface that is in contact with the first inclined surface.

23. The swing apparatus according to claim 15, wherein the latch member is biased toward the first position by a spring.

24. The swing apparatus according to claim 15, wherein an outer peripheral edge of the latch member includes a plurality of first teeth, and the first teeth engage with a plurality of second and third teeth respectively provided in the first and the second coupling shell when the latch member is located at the first position.

25. The swing apparatus according to claim 24, wherein the outer peripheral edge of the latch member further includes a radial rib having a width larger than a pitch of the second teeth, an inner surface of the first coupling shell includes a restricting groove that has a width greater than the radial rib, and the radial rib is positioned in the restricting groove when the latch member is in the first position.

26. The swing apparatus according to claim 15, wherein the seating portion includes a seat support tube that is affixed with the second coupling shell.

* * * * *